US011315506B2

(12) United States Patent
Kang

(10) Patent No.: US 11,315,506 B2
(45) Date of Patent: Apr. 26, 2022

(54) DRIVING METHOD FOR LIQUID CRYSTAL DISPLAY DEVICE AND LIQUID CRYSTAL DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/040,151

(22) PCT Filed: Nov. 14, 2018

(86) PCT No.: PCT/CN2018/115317
§ 371 (c)(1),
(2) Date: Sep. 22, 2020

(87) PCT Pub. No.: WO2019/184383
PCT Pub. Date: Oct. 3, 2019

(65) Prior Publication Data

US 2021/0027730 A1 Jan. 28, 2021

(30) Foreign Application Priority Data

Mar. 30, 2018 (CN) ..... 201810294118.8

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 3/3648* (2013.01);
(Continued)

(58) Field of Classification Search
CPC ..... G09G 3/3607; G09G 3/3406; G09G 2300/0452; G09G 2310/08;
(Continued)

(56) References Cited

U.S. PATENT DOCUMENTS 8,237,749 B2 * 8/2012 Kim ..... G09G 5/02 345/690
8,780,133 B2 * 7/2014 Jeong ..... G09G 5/02 345/590

(Continued)

FOREIGN PATENT DOCUMENTS

CN 104570430 A 4/2015
CN 107657928 A 2/2018

(Continued)

*Primary Examiner* — Michael J Jansen, II

(57) ABSTRACT

This application relates to a display device and a driving method thereof. An original gray-scale data group is decomposed into three gray-scale data groups for respective output and display in three consecutive time periods according to a determined type of a color corresponding to the original gray-scale data group to be displayed by a pixel unit.

14 Claims, 6 Drawing Sheets

(52) U.S. Cl.
CPC ..... *G09G 2300/0452* (2013.01); *G09G 2310/0235* (2013.01); *G09G 2310/08* (2013.01); *G09G 2320/028* (2013.01); *G09G 2320/0242* (2013.01); *G09G 2320/0247* (2013.01); *G09G 2320/0252* (2013.01); *G09G 2320/068* (2013.01); *G09G 2320/0626* (2013.01)

(58) Field of Classification Search
CPC ... G09G 2320/0242; G09G 2320/0252; G09G 2320/0626; G09G 2310/0235; G09G 3/36; G09G 3/3648; G09G 2320/0247; G09G 2320/028; G09G 2320/068
See application file for complete search history.

(56) References Cited

U.S. PATENT DOCUMENTS 9,280,940 B2 * 3/2016 Chen ..... G09G 3/3607
9,293,091 B2 * 3/2016 Lee ..... G02F 1/133514
9,646,549 B2 * 5/2017 Chen ..... G09G 3/3607
9,728,160 B2 * 8/2017 Yang ..... G09G 5/02
9,786,231 B2 * 10/2017 Matsui ..... G09G 3/32
9,842,550 B2 * 12/2017 Im ..... G09G 3/3648
9,928,798 B2 * 3/2018 Um ..... G09G 3/3655
10,013,908 B2 * 7/2018 Li ..... G09G 3/2044
10,276,079 B2 * 4/2019 Lim ..... G09G 3/3607
10,522,100 B2 * 12/2019 Jeong ..... G09G 3/3607
10,665,148 B2 * 5/2020 Kang ..... G09G 3/2003
10,720,114 B2 * 7/2020 Choi ..... G09G 3/3607
10,978,013 B2 * 4/2021 Kang ..... G09G 3/3607
11,062,647 B2 * 7/2021 Hwang ..... G09G 3/3225
11,132,965 B2 * 9/2021 Kang ..... G09G 3/3413
2008/0284720 A1 * 11/2008 Fukutome ..... G09G 3/3406 345/102
2009/0066731 A1 * 3/2009 Kim ..... G09G 3/3607 345/690
2009/0102865 A1 4/2009 Chen et al.
2010/0309107 A1 * 12/2010 Muroi ..... G09G 3/3426 345/88
2011/0148908 A1 * 6/2011 Jeong ..... G09G 5/02 345/590
2015/0228232 A1 * 8/2015 Lee ..... G02F 1/133514 345/88
2015/0325161 A1 * 11/2015 Um ..... G09G 3/3655 345/209
2016/0019851 A1 * 1/2016 Chen ..... G09G 3/3607 345/89
2016/0049123 A1 * 2/2016 Jeong ..... G09G 3/3607 345/690
2016/0117997 A1 * 4/2016 Matsui ..... G09G 3/36 345/691
2016/0155394 A1 * 6/2016 Im ..... G09G 3/3413 345/694
2016/0260393 A1 * 9/2016 Chen ..... G09G 3/3607
2016/0267685 A1 * 9/2016 Yang ..... G09G 5/02
2017/0069244 A1 * 3/2017 Lim ..... G09G 3/3607
2017/0103696 A1 * 4/2017 Li ..... G09G 3/2074
2018/0308414 A1 * 10/2018 Kang ..... G09G 3/3614
2019/0057661 A1 * 2/2019 Choi ..... G09G 3/3611
2019/0156739 A1 * 5/2019 Hwang ..... G09G 3/20
2021/0012729 A1 * 1/2021 Kang ..... G09G 3/3413
2021/0020128 A1 * 1/2021 Kang ..... G09G 3/3426
2021/0027730 A1 * 1/2021 Kang ..... G09G 3/3406
2021/0049970 A1 * 2/2021 Kang ..... G09G 3/342

FOREIGN PATENT DOCUMENTS

CN 107799079 A 3/2018
CN 107808648 A 3/2018
CN 108346408 A 7/2018

* cited by examiner

DRIVING METHOD FOR LIQUID CRYSTAL DISPLAY DEVICE AND LIQUID CRYSTAL DISPLAY DEVICE

TECHNICAL FIELD

This application relates to the field of liquid crystal display technology, and particularly relates to a driving method for a liquid crystal display device and a liquid crystal display device.

BACKGROUND

In large-viewing-angle and front-viewing-angle color shift changes of each representative color system of a liquid crystal display, large-viewing-angle color shift conditions of color systems of Red, Green and Blue (RGB) are more serious than those of other color systems. Moreover, rapid saturation increase of a viewing angle to luminance ratio of gray-scale liquid crystal display makes the difference between the front-viewing-angle luminance and the side-viewing-angle luminance to be larger as the gray-scale value lowers.

At present, a manner for alleviating a color shift is to subdivide each sub-pixel into a primary pixel and a secondary pixel, then drive the primary pixel with a relatively high drive voltage and drive the secondary pixel with a relatively low drive voltage, the primary pixel and the secondary pixel displaying the sub-pixel together. Moreover, when the primary pixel and the secondary pixel are driven with the relatively high drive voltage and the relatively low drive voltage respectively, a relationship between luminance at a front viewing angle and a corresponding gray-scale may be kept unchanged. According to such a method, under a normal condition, in a first half of the gray-scale, the primary pixel is driven with the relatively high drive voltage for display, the secondary pixel is not displayed and luminance of the whole sub-pixel is half of luminance of the primary pixel; and in a second half of the gray-scale, the primary pixel is driven with the relatively high drive voltage for display, the secondary pixel is driven with the relatively low drive voltage for display and the luminance of the whole sub-pixel is half of a sum of the luminance of the primary pixel and luminance of the secondary pixel. After combination like this, a color shift condition at a large viewing angle is alleviated to a certain extent. However, metal wires and drive devices are required to be doubled to drive the secondary pixels, so that an aperture ratio of a panel is reduced, light transmittance of the panel is affected and, in addition, production cost is increased.

SUMMARY

Based on the above, this application provides a driving method for a liquid crystal display device and a liquid crystal display device, so as to resolve the problem of large-viewing-angle color shift without increasing the costs.

This application provides a driving method for a liquid crystal display device, the driving method including:

determining a type of a color corresponding to an original gray-scale data group to be displayed by a pixel unit;

dividing the original gray-scale data group into a first gray-scale data group, a second gray-scale data group and a third gray-scale data group according to the type of the color corresponding to the original gray-scale data group to be displayed by the pixel unit in accordance with a set grouping rule; and outputting and displaying the first gray-scale data group, the second gray-scale data group and the third gray-scale data group in three consecutive time periods respectively.

On the basis of the same inventive concept, this application also provides a driving method for a liquid crystal display device, the liquid crystal display device including a display module, the display module including a plurality of pixel units arranged in an array and the driving method being characterized by including the following steps:

determining a type of a color corresponding to an original gray-scale data group to be displayed by each pixel unit;

dividing the original gray-scale data group into a first gray-scale data group, a second gray-scale data group and a third gray-scale data group according to the type of the color corresponding to the original gray-scale data group to be displayed by each pixel unit in accordance with a set grouping rule; and outputting and displaying the first gray-scale data group, second gray-scale data group and third gray-scale data group corresponding to each pixel unit in three consecutive time periods respectively.

On the basis of the same inventive concept, this application also provides a liquid crystal display device, the liquid crystal display device including:

a display module, configured to display graphic and text information, the display module including a plurality of pixel units arranged in an array, and each pixel unit including an R sub-pixel, a G sub-pixel and a B sub-pixel;

a drive module, configured to receive, process and output drive data to control the display module to normally work, the drive module including a gray-scale data decomposition processing unit, a driving frequency regulation unit and a backlight luminance regulation unit, the gray-scale data decomposition processing unit being configured to decompose an input original gray-scale data group corresponding to each pixel unit into three new gray-scale data groups and output gray-scale values of the R sub-pixel, G sub-pixel and B sub-pixel in the pixel units in three consecutive time periods, the gray-scale data decomposition processing unit being connected with all the R sub-pixels, G sub-pixels and B sub-pixels in the display module, the driving frequency regulation unit being configured to regulate a driving frequency, and the backlight luminance regulation unit being configured to regulate luminance of a backlight unit; and a backlight module, configured to convert a direct current voltage into a high-frequency high-voltage alternating current to turn on the backlight unit, the backlight module including a power processing unit and the backlight unit.

According to the method and the device, the type of the color corresponding to the original gray-scale data group to be displayed by each pixel unit is determined, and the original gray-scale data group is divided into the first gray-scale data group, the second gray-scale data group and the third gray-scale data group according to the type of the color corresponding to the original gray-scale data group to be displayed by the pixel unit in accordance with the set grouping rule for respective output and display in the three consecutive time periods. A luminance ratio of a dominant hue is increased and a color shift condition caused by the fact that the dominant hue is affected by low-voltage sub-pixels at a large viewing angle is alleviated. Presentation luminance of a main signal under a large-viewing-angle condition is increased. In addition, the backlight luminance is increased to be three times of original luminance to keep overall picture display luminance unchanged and the driving frequency is increased to be three times of an original driving frequency to keep an overall picture display speed unchanged. Moreover, additional wires arranged on a liquid crystal display panel are also avoided.

DETAILED DESCRIPTION OF THE EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
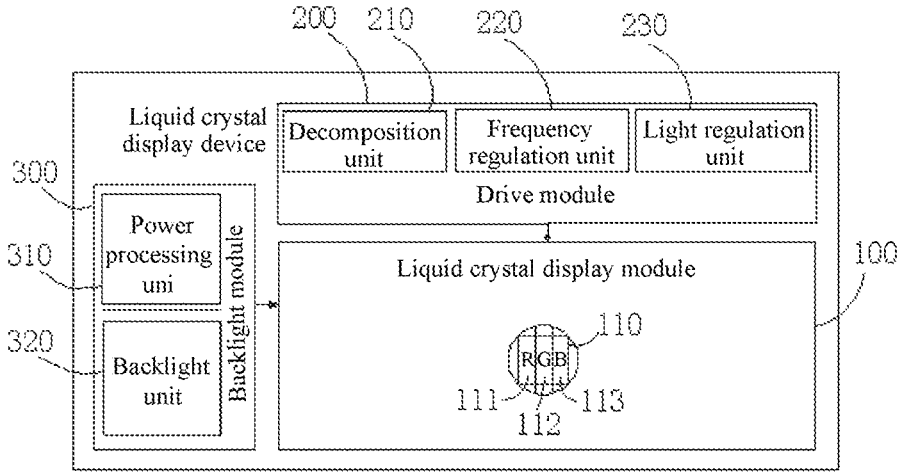
FIG. 1 is a schematic structural diagram of modules of a liquid crystal display device.

This application provides a driving method for a liquid crystal display device. As shown in FIG. 1, the liquid crystal display device includes a display module 100. The display module 100 includes a plurality of pixel units 110 arranged in an array. Each pixel unit 110 includes an R sub-pixel 111, a G sub-pixel 112 and a B sub-pixel 113. A color generated by each pixel unit 110 is any one of three types of a unitary color, a binary mixed color and a ternary mixed color. The driving method is as follows.

A type of a color corresponding to an original gray-scale data group to be displayed by a pixel unit 110 is determined.

The original gray-scale data group is divided into a first gray-scale data group, a second gray-scale data group and a third gray-scale data group according to the type of the color corresponding to the original gray-scale data group to be displayed by the pixel unit 110 in accordance with a set grouping rule.

The first gray-scale data group, the second gray-scale data group and the third gray-scale data group are output and displayed in three consecutive time periods respectively.

In the above contents, the pixel unit 110 generates a color every time when receiving a gray-scale value group. The gray-scale value group is generated by gray-scale data input into the liquid crystal display device. The gray-scale value group includes a red (R) gray-scale value, a green (G) gray-scale value and a blue (B) gray-scale value.

Herein, determining the type of the color corresponding to original gray-scale data according to the amount of zero gray-scale data in the original gray-scale data group to be displayed by the pixel unit 110 includes:

when the original gray-scale data group includes no zero gray-scale data, the color corresponding to the original gray-scale data group is a ternary mixed color;

when the original gray-scale data group includes one piece of zero gray-scale data, the color corresponding to the original gray-scale data group is a binary mixed color; and when the original gray-scale data group includes two pieces of zero gray-scale data, the color corresponding to the original gray-scale data group is a unitary color.

Figure 2:
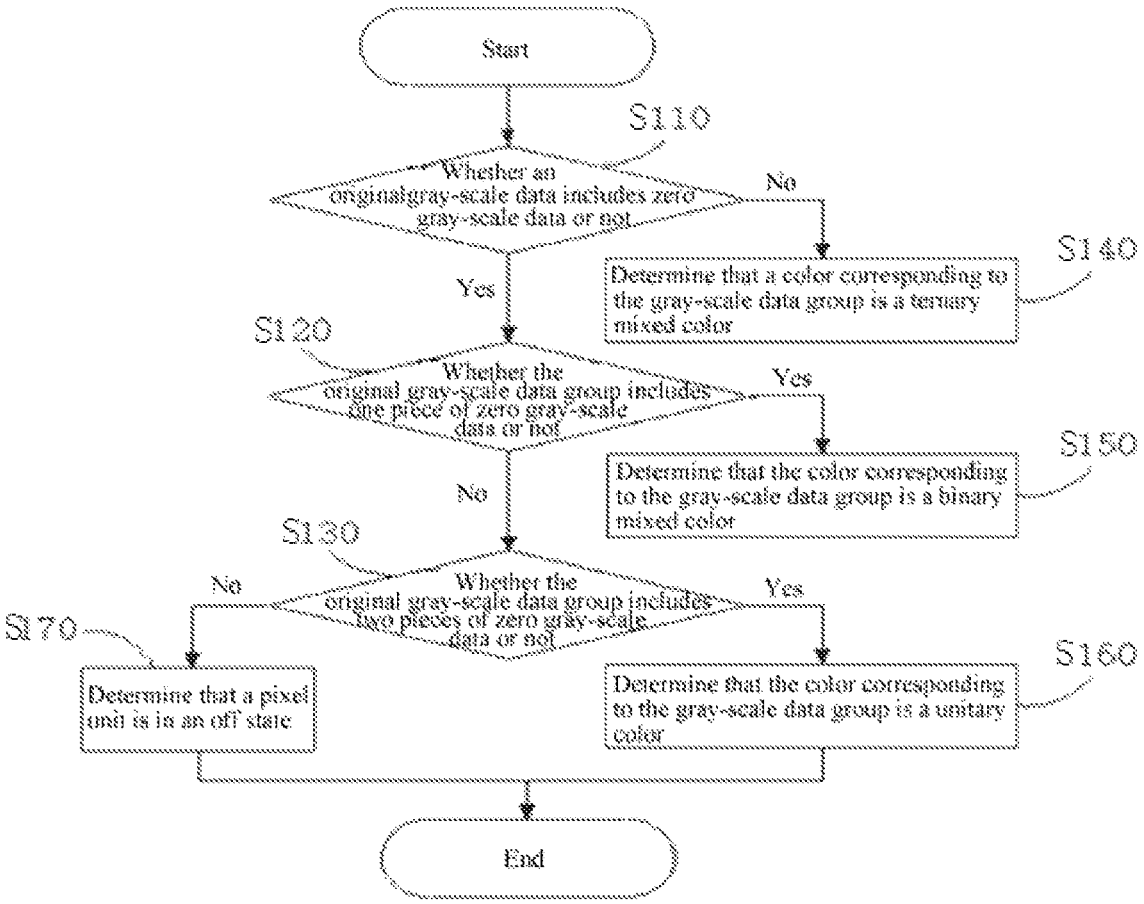
FIG. 2 is a flowchart of determining a type of a color displayed by a pixel unit corresponding to an original gray-scale data group in a driving method.

Specifically, as shown in FIG. 2, in an embodiment, a method for determining the type of the color corresponding to the original gray-scale data group to be displayed by the pixel unit 110 specifically includes steps S110-S170.

In step S110, whether the original gray-scale data group to be displayed by the pixel unit 110 includes zero gray-scale data or not is determined, if not, step S140 is performed, otherwise step S120 is performed. If a certain color is of a ternary mixed color type, it indicates that the color includes three color components RGB. In the field of liquid crystal display technologies, gray-scale values of the R sub-pixel 111, G sub-pixel 112 and B sub-pixel 113 in the pixel unit 110 are all not zero. That is, the corresponding original gray-scale data group includes no zero gray-scale data. Therefore, whether the original gray-scale data group is a ternary mixed color gray-scale data group or not can be determined by determining whether the original gray-scale data group includes zero gray-scale data or not.

In step S120, whether the original gray-scale data group to be displayed by the pixel unit 110 includes only one piece of zero gray-scale data or not is determined, if yes, step S150 is performed, otherwise step S130 is performed. If a certain color is of a binary mixed color type, it indicates that the color includes any two of the three color components RGB. In the field of liquid crystal display technologies, only one of the gray-scale values of the R sub-pixel 111, G sub-pixel 112 and B sub-pixel 113 in the corresponding pixel unit 110 is zero and the other two are not zero. That is, the corresponding original gray-scale data group includes only one piece of zero gray-scale data. Therefore, whether the original gray-scale data group is a binary mixed color gray-scale data group or not can be determined by determining whether the original gray-scale data group includes only one piece of zero gray-scale data or not.

In step S130, whether the original gray-scale data group to be displayed by the pixel unit 110 includes only two pieces of zero gray-scale data or not is determined, if yes, step S160 is performed, otherwise step S170 is performed. If a certain color is of a unitary color type, it indicates that the color only includes any one of the three color components RGB. In the field of liquid crystal display technologies, only two of the gray-scale values of the R sub-pixel 111, G sub-pixel 112 and B sub-pixel 113 in the corresponding pixel unit 110 are zero and the other one is not zero. That is, the corresponding original gray-scale data group includes only two pieces of zero gray-scale data. Therefore, whether the original gray-scale data group is a unitary color gray-scale data group or not can be determined by determining whether the original gray-scale data group includes only two pieces of zero gray-scale data or not.

In step S140, it is determined that the color displayed by the pixel unit 110 corresponding to the gray-scale data group is a ternary mixed color.

In step S150, it is determined that the color displayed by the pixel unit 110 corresponding to the gray-scale data group is a binary mixed color.

In step S160, it is determined that the color displayed by the pixel unit 110 corresponding to the gray-scale data group is a unitary color.

In step S170, it is determined that the pixel unit 110 corresponding to the gray-scale data group is in an off state. If the gray-scale values corresponding to the sub-pixels of a certain pixel unit are all 0, it indicates that the pixel unit is responsible for no display task. In such case, the pixel unit has a sub-pixel voltage of 0 and is in the off state and; since no light can be transmitted through a liquid crystal, the pixel unit is black.

The grouping rule is specifically as follows.

Minimum original gray-scale data in the original gray-scale data group corresponding to a ternary mixed color pixel unit 110 is used as common gray-scale data of the R sub-pixel 111, the G sub-pixel 112 and the B sub-pixel 113 in the pixel unit to form the first gray-scale data group.

Minimum non-zero gray-scale data in a difference data group obtained by subtracting the first gray-scale data group from the original gray-scale data group corresponding to the ternary mixed color pixel unit 110 is used as common gray-scale data of the sub-pixels corresponding to non-zero gray-scale data in the difference data group to form the second gray-scale data group together with the zero gray-scale data.

A difference data group obtained by subtracting the first gray-scale data group and the second gray-scale data group from the original gray-scale data group corresponding to the ternary mixed color pixel unit 110 is used as the third gray-scale data group.

Zero gray-scale data in the original gray-scale data group corresponding to a binary mixed color pixel unit 110 is used as common gray-scale data of the R sub-pixel 111, G sub-pixel 112 and B sub-pixel 113 in the pixel unit 110 to form the first gray-scale data group.

Minimum non-zero gray-scale data in the original gray-scale data group corresponding to the binary mixed color pixel unit 110 is used as common gray-scale data of the sub-pixels corresponding to non-zero gray-scale data in the original gray-scale data group to form the second gray-scale data group together with the zero gray-scale data.

A difference data group obtained by subtracting the second gray-scale data group from the original gray-scale data group corresponding to the binary mixed color pixel unit 110 is used as the third gray-scale data group.

Alternatively, gray-scale data corresponding to half of the gray-scale values corresponding to the minimum non-zero gray-scale data in the original gray-scale data group corresponding to the binary mixed color pixel unit 110 is used as common gray-scale data of the sub-pixels corresponding to two pieces of non-zero gray-scale data in the pixel unit to form the first gray-scale data group and the second gray-scale data group together with the zero gray-scale data respectively.

A difference data group obtained by subtracting the first gray-scale data group and the second gray-scale data group from the original gray-scale data group corresponding to the binary mixed color pixel unit 110 is used as the third gray-scale data group.

Any piece of zero gray-scale data in the original gray-scale data group corresponding to the unitary color pixel unit 110 is used as common gray-scale data of the R sub-pixel 111, G sub-pixel 112 and B sub-pixel 113 in the pixel unit to form the first gray-scale data group and the second gray-scale data group.

The original gray-scale data group corresponding to the unitary color pixel unit 110 is used as the third gray-scale data group.

Alternatively, gray-scale data corresponding to ⅓ of the gray-scale values corresponding to the non-zero gray-scale data in the original gray-scale data group corresponding to the unitary color pixel unit 110 is used as gray-scale data of the sub-pixels corresponding to the non-zero gray-scale data in the pixel unit to form the first gray-scale data group, the second gray-scale data group and the third gray-scale data group together with the zero gray-scale data respectively.

Figure 3:
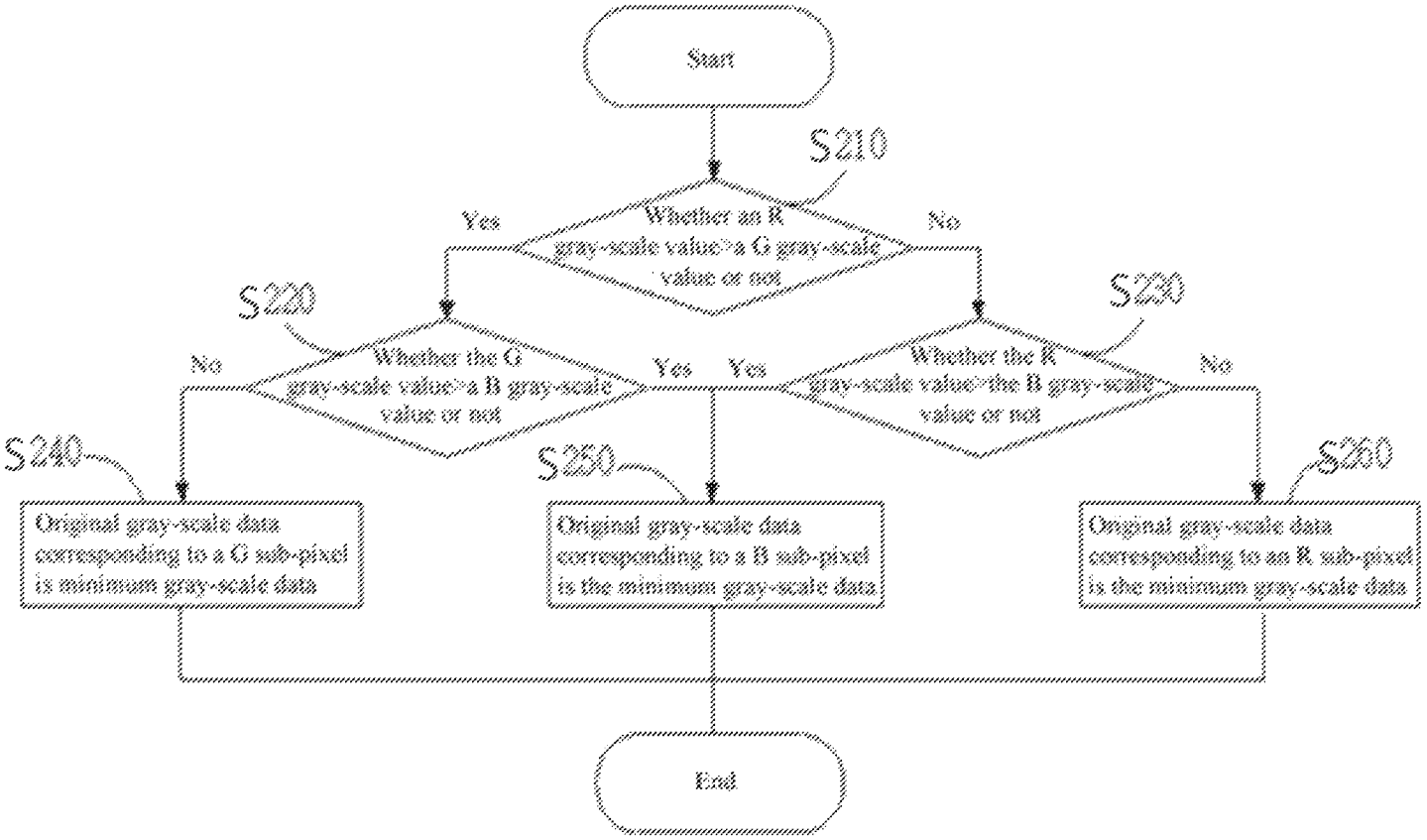
FIG. 3 is a flowchart of determining minimum gray-scale data in a ternary mixed color gray-scale data group in a driving method.

Herein, in an embodiment shown in FIG. 3, a method for determining minimum gray-scale data in a ternary mixed color gray-scale data group specifically includes steps S210-S260.

In step S210, whether an R gray-scale value in an original gray-scale value group corresponding to the original gray-scale data group to be displayed by a ternary mixed color pixel unit is greater than a G gray-scale value or not is determined, if yes, step S220 is performed, otherwise step S230 is performed. Determining a magnitude relationship between the gray-scale value corresponding to the R sub-pixel 111 and the gray-scale value of the G sub-pixel 112 at first in step S210 is only a condition listed for convenient description. In fact, the gray-scale values of any two colors in the RGB sub-pixels may be used for determining at first.

In step S220, whether the G gray-scale value in the original gray-scale value group is greater than a B gray-scale value or not is determined, if yes, step S250 is performed, otherwise step S240 is performed. In the step, the smaller gray-scale value in step S210 is compared with the gray-scale value of another color for determining and a corresponding determining result and action signal are output.

In step S230, whether the R gray-scale value in the original gray-scale value group is greater than the B gray-scale value or not is determined, if yes, step S250 is performed, otherwise step S260 is performed. In the step, the smaller gray-scale value in step S210 is compared with the gray-scale value of another color for determine and a corresponding determining result and action signal are output.

In step S240, it is determined that gray-scale data corresponding to the G sub-pixel in the original gray-scale data group is the minimum original gray-scale data.

In step S250, it is determined that gray-scale data corresponding to the B sub-pixel in the original gray-scale data group is the minimum original gray-scale data.

In step S260, it is determined that gray-scale data corresponding to the R sub-pixel in the original gray-scale data group is the minimum original gray-scale data.

Figure 4:
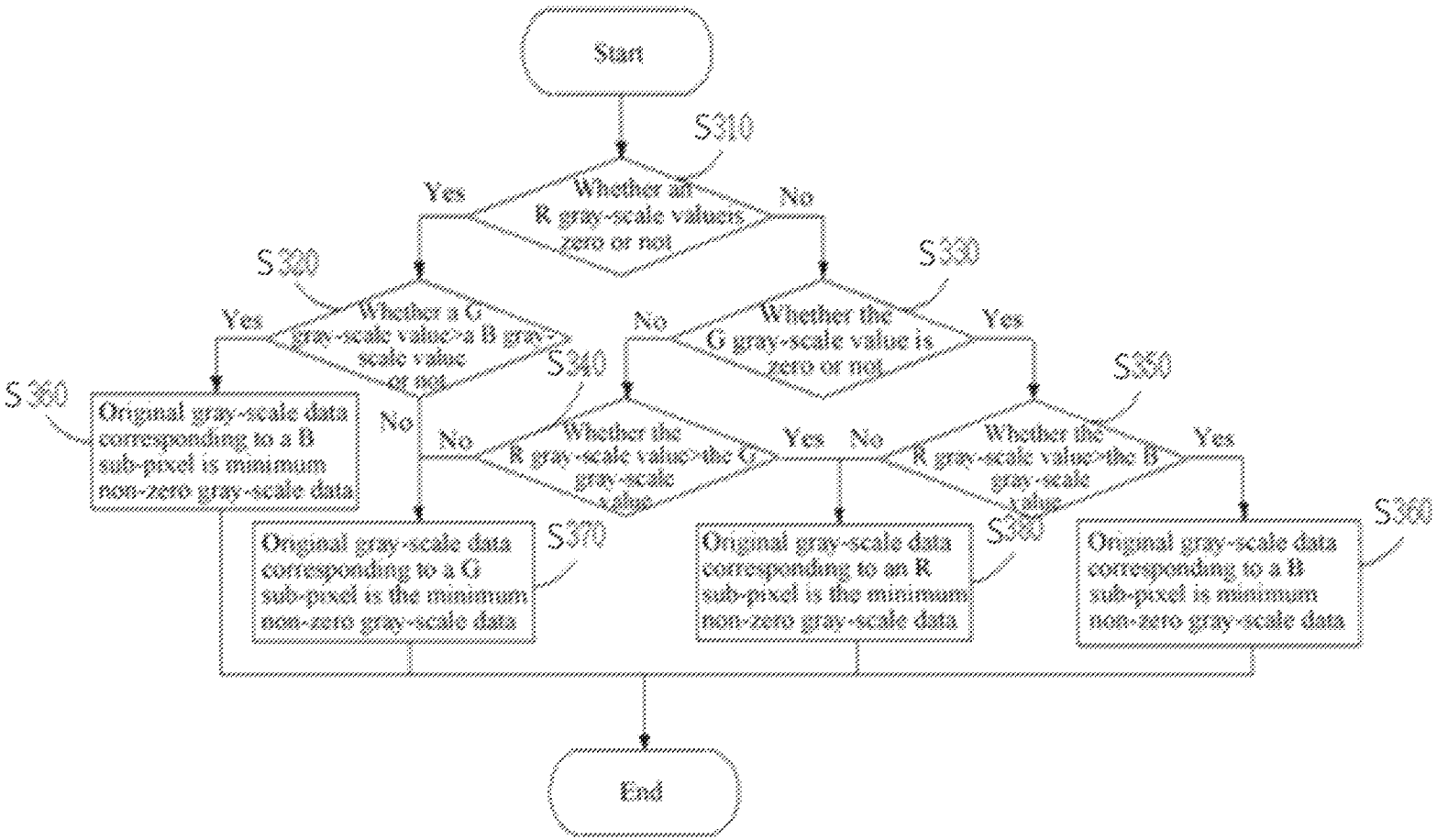
FIG. 4 is a flowchart of determining minimum non-zero gray-scale data in a binary mixed color gray-scale data group in a driving method.
Figure 5:
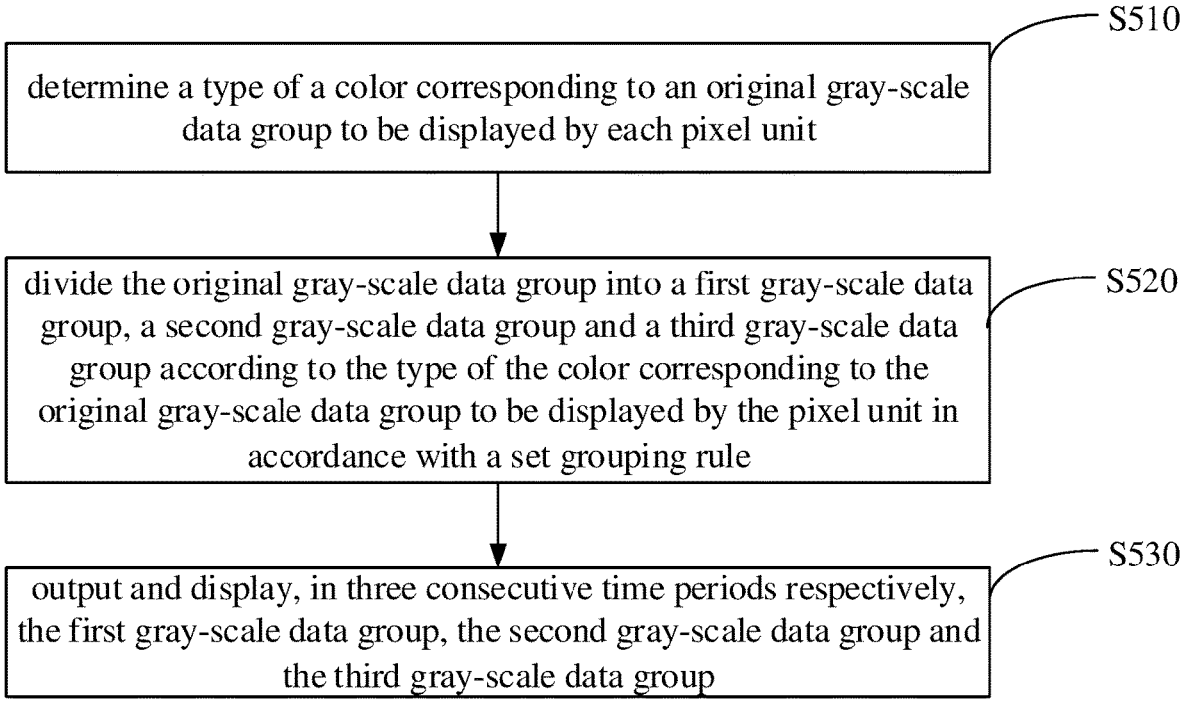
FIG. 5 is a flowchart of a driving method for a liquid crystal display device according to an embodiment of the application.
Figure 6:
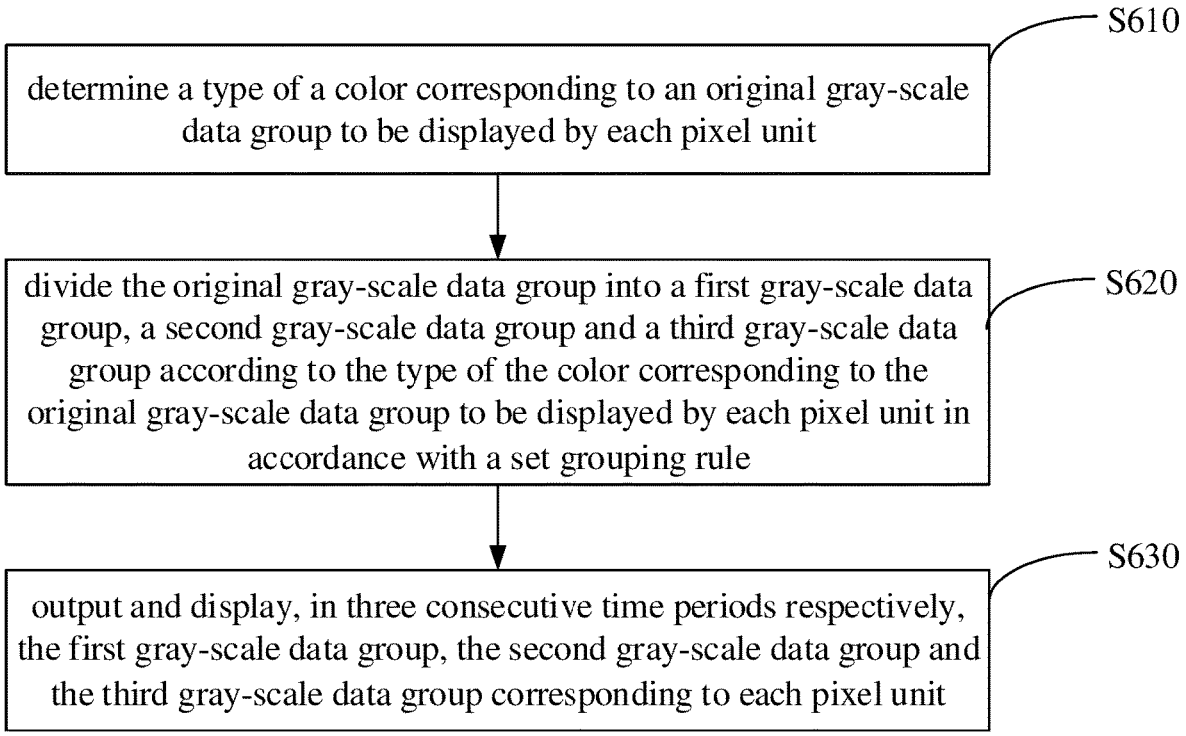
FIG. 6 is a flowchart of a driving method for a liquid crystal display device according to another embodiment of the application.

In an embodiment shown in FIG. 4, a method for determining minimum non-zero gray-scale data in a binary mixed color gray-scale data group specifically includes steps S310-S380.

In step S310, whether an R gray-scale value in an original gray-scale value group corresponding to the original gray-scale data group to be displayed by a binary mixed color pixel unit is zero or not is determined, if yes, step S320 is performed, otherwise step S330 is performed.

If a certain type is of a binary mixed color type, it indicates that the color includes any two of three color components RGB. In the field of liquid crystal display technologies, only one of gray-scale values of the R sub-pixel, G sub-pixel and B sub-pixel in the corresponding pixel unit is zero and the other two are not zero. That is, the corresponding original gray-scale data group includes only one piece of zero gray-scale data. Determining whether the gray-scale value corresponding to the R sub-pixel 111 is zero or not at first in step S310 is only a condition listed for convenient description. In fact, the gray-scale value of one color in the RGB sub-pixels may be used for determining at first.

In step S320, whether a G gray-scale value corresponding to the pixel unit of which the gray-scale value of the R sub-pixel is zero is greater than a B gray-scale value or not is determined, if yes, step S360 is performed, otherwise step S370 is performed. In the step, when determining that the gray-scale value corresponding to the R sub-pixel 111 is zero, it is determined that the color displayed by the pixel unit is a mixed color of G and B. Therefore, the minimum non-zero gray-scale data in the original gray-scale data group corresponding to the pixel unit can be determined by determining a magnitude relationship between the G gray-scale value and the B gray-scale value.

In step S330, whether the G gray-scale value corresponding to the pixel unit of which the gray-scale value of the R sub-pixel is not zero is zero or not is determined, if yes, step S350 is performed, otherwise step S340 is performed. Determining whether the gray-scale value corresponding to the G sub-pixel 112 is zero or not when it is determined that the gray-scale value corresponding to the R sub-pixel 111 is not zero in the step is only a condition listed for convenient description. In fact, the gray-scale value of the B sub-pixel may also be used for determining.

In step S340, whether the R gray-scale value corresponding to the pixel unit of which the gray-scale value of the B sub-pixel is zero is greater than the G gray-scale value or not is determined, if yes, step S380 is performed, otherwise step S370 is performed. In step S340, when determining that the gray-scale value corresponding to the B sub-pixel 113 is zero, it is determined that the color displayed by the pixel unit is a mixed color of G and R. Therefore, the minimum non-zero gray-scale data in the original gray-scale data group corresponding to the pixel unit can be determined by determining a magnitude relationship between the G gray-scale value and the R gray-scale value.

In step S350, whether the R gray-scale value corresponding to the pixel unit of which the gray-scale value of the G sub-pixel is zero is greater than the B gray-scale value or not is determined, if yes, step S360 is performed, otherwise step S380 is performed. In the step, when determining that the gray-scale value corresponding to the G sub-pixel 112 is zero, it is determined that the color displayed by the pixel unit is a mixed color of R and B. Therefore, the minimum non-zero gray-scale data in the original gray-scale data group corresponding to the pixel unit can be determined by determining a magnitude relationship between the R gray-scale value and the B gray-scale value.

In step S360, it is determined that the original gray-scale data corresponding to the B sub-pixel in the original gray-scale data group corresponding to the binary mixed color pixel unit is the minimum non-zero gray-scale data.

In step S370, it is determined that the original gray-scale data corresponding to the G sub-pixel in the original gray-scale data group corresponding to the binary mixed color pixel unit is the minimum non-zero gray-scale data.

In step S380, it is determined that the original gray-scale data corresponding to the R sub-pixel in the original gray-scale data group corresponding to the binary mixed color pixel unit is the minimum non-zero gray-scale data.

Since rapid saturation increase of a viewing angle to luminance ratio of gray-scale liquid crystal display makes a difference between the front-viewing-angle luminance and the side-viewing-angle luminance to be larger as the gray-scale value lowers, in the grouping rule, for highlighting dominant colors and alleviating a color shift, the minimum gray-scale data in the original gray-scale data group is placed in a separate gray-scale data group for display and colors including no minimum gray-scale data may be displayed in the other groups. Therefore, impact, caused by rapid saturation increase of the viewing angle to luminance ratio of gray-scale liquid crystal display, of minimum gray-scale colors in the groups on display of the dominant colors is eliminated. For describing the grouping rule more clearly and directly, grouping descriptions will be made as follows with gray-scale value groups. It is to be noted that a grouping process refers to data grouping implemented when the original gray-scale data group is processed and the descriptions are made herein with the gray-scale value groups only for convenience and simplicity.

It is assumed that an original gray-scale data group corresponding to a certain pixel unit 110 is converted into an original gray-scale value group (A, B, C). That is, a gray-scale value corresponding to the R sub-pixel 111 is A, a gray-scale value corresponding to the G sub-pixel 112 is B and a gray-scale value corresponding to the B sub-pixel 113 is C. When A>B>C, it can be determined that the gray-scale value corresponding to the B sub-pixel 113 is a minimum gray-scale value, i.e., a smallest gray-scale value, in the original gray-scale values, and a difference between front-viewing-angle luminance and side-viewing-angle luminance at the minimum gray-scale value is maximum. For reducing impact of the minimum gray-scale value, the minimum gray-scale value is now used as a common gray-scale value of the R sub-pixel 111, the G sub-pixel 112 and the B sub-pixel 113 to form a first gray-scale value group, i.e., (C, C, C). Minimum non-zero gray-scale data in a difference group obtained by subtracting the minimum gray-scale value from the gray-scale values corresponding to the R sub-pixel 111, the G sub-pixel 112 and the B sub-pixel 113 in the original gray-scale data is used as common gray-scale data of non-zero gray-scale data in the difference value to form a second gray-scale value group, i.e., (B-C, B-C, 0). A difference obtained by subtracting the first gray-scale value group and the second gray-scale value group from the gray-scale values corresponding to the R sub-pixel 111, the G sub-pixel 112 and the B sub-pixel 113 in the original gray-scale data group form a third gray-scale value group, i.e., (A-B, 0, 0). By means of such setting, the minimum gray-scale value can be eliminated from the second gray-scale value group and the third gray-scale value group and impact of the minimum gray-scale value on the color shift under a large-viewing-angle condition during display of the second gray-scale value group and the third gray-scale value group can be eliminated. In the overall effect of continuously displaying the three gray-scale value groups, it can be seen from a luminance change property of a unitary color under the large-viewing-angle liquid crystal display condition that a ratio of a gray-scale value sum of the decomposed dominant colors to a low gray-scale value is increased, so that not only is the color shift at a side viewing angle alleviated but also the luminance of the dominant colors is increased.

In the above contents, each of the gray-scale value data group and the gray-scale value group is a data group using the pixel unit 110 as a minimum unit and including the gray-scale data or gray-scale values corresponding to the R sub-pixel 111, the G sub-pixel 112 and the B sub-pixel 113 respectively. The original gray-scale data group is an original gray-scale value data group including the RGB gray-scale data and input into the display device. The original gray-scale value group is a gray-scale value group directly converted from the original gray-scale data group and including the RGB gray-scale data.

In the grouping rule, the original gray-scale data groups corresponding to a binary mixed color and a unitary color are decomposed into gray-scale data groups including all-0 gray-scale data for synchronization with an execution control manner for the gray-scale data group corresponding to a ternary mixed color and convenient drive and control.

In addition, the driving method further includes that the driving frequency of the pixel unit is increased to be 1 to 4 times of the original frequency to compensate for a display speed reduced by gray-scale value decomposition. Decomposing an original gray-scale value into three gray-scale values for display in three consecutive time periods prolongs display time of a picture to be three times of original time, namely reduces the display speed to be ⅓ of the original speed. To compensate for the display speed reduced by gray-scale value decomposition, the driving frequency can be increased.

In an embodiment, the driving frequency of the pixel unit is increased to be three times of the original frequency to keep a display speed of the pixel unit subjected to gray-scale value decomposition the same as a display speed before gray-scale value decomposition. By means of such setting, picture fluency after gray-scale value decomposition for display is kept substantially the same as picture fluency during original gray-scale data display and the problem of color shift of liquid crystal display is alleviated without affecting the original visual effect.

In an embodiment, the liquid crystal display device further includes a backlight module 300. The backlight module 300 includes a backlight unit 320 configured to provide a backlight source. The driving method further includes that luminance of the backlight unit 320 is increased to be 1 to 4 times of original luminance to compensate for luminance reduced by gray-scale value decomposition. A gray-scale value decomposition process refers to decomposing an original high gray-scale value into three new low gray-scale values. That is, a group of high-voltage signals are actually decomposed into three groups of low-voltage signals, so that the luminance is reduced. On the other hand, since an original gray-scale value is decomposed into three gray-scale values for display in three consecutive time periods, the display time of the picture is prolonged to be three times of the original time. That is, the display speed is reduced to be ⅓ of the original speed. To compensate for the display speed reduced by gray-scale value decomposition, the driving frequency is usually increased. After the driving frequency is increased, the luminance may be reduced because practical display time of each gray-scale data group is shorter than that under the original driving frequency. For example, if the original driving frequency is increased to be three times of the original driving frequency, the luminance is reduced, since practical display time of a drive signal is shortened to be ⅓ of original time of the drive signal. To compensate for the luminance reduced by gray-scale value decomposition, or increase of the driving frequency or co-actions of gray-scale value decomposition and increase of the driving frequency, the backlight luminance can be increased.

In an embodiment, the luminance of the backlight unit 320 is increased to be three times of the original luminance to keep luminance of the pixel unit subjected to gray-scale value decomposition the same as luminance before gray-scale value decomposition. By means of such setting, an effect after gray-scale value decomposition for display is kept substantially the same as an effect during original gray-scale data display and the problem of color shift of liquid crystal display is alleviated without affecting the original visual effect.

In an embodiment, the backlight unit 320 may be an RGB type LED lamp, a white light type LED lamp or another light source and will not be limited herein.

In an embodiment, the pixel unit 110 includes four and more than four sub-pixels of different colors.

In an embodiment, the pixel unit 110 includes four sub-pixels of different colors and, besides the R sub-pixel, the G sub-pixel and the B sub-pixel, may further include, for example, a white sub-pixel, a yellow sub-pixel, an orange sub-pixel or a sub-pixel of another color. A corresponding setting is made according to a requirement of a practical condition.

In an embodiment, the pixel unit 110 includes a plurality of sub-pixels of different colors. For example, the pixel unit includes sub-pixels of three colors, i.e., a white sub-pixel, a yellow sub-pixel and an orange sub-pixel. A corresponding setting is made according to a requirement of a practical condition.

According to the method, the type of the color corresponding to the original gray-scale data group to be displayed by each pixel unit is determined, and the original gray-scale data group is divided into the first gray-scale data group, the second gray-scale data group and the third gray-scale data group according to the type of the color corresponding to the original gray-scale data group to be displayed by the pixel unit in accordance with the set grouping rule for respective output and display in the three consecutive time periods. A luminance ratio of a dominant hue is increased and a color shift condition caused by the fact that the dominant hue is affected by low-voltage sub-pixels at a large viewing angle is alleviated. Presentation luminance of a main signal under a large-viewing-angle condition is increased. In addition, the backlight luminance is increased to be three times of original luminance to keep overall picture display luminance unchanged and the driving frequency is increased to be three times of the original driving frequency to keep an overall picture display speed unchanged. Moreover, additional wires arranged on a liquid crystal display panel are also avoided.

This application also provides another driving method for a liquid crystal display device.

As shown in FIG. 1, the liquid crystal display device includes a display module 100. The display module 100 includes a plurality of pixel units 110 arranged in an array. The driving method is as follows.

A type of a color corresponding to an original gray-scale data group to be displayed by each pixel unit 110 is determined.

The original gray-scale data group is divided into a first gray-scale data group and a second gray-scale data group according to the type of the color corresponding to the original gray-scale data group to be displayed by each pixel unit 110 in accordance with a set grouping rule.

The first gray-scale data group and the second gray-scale data group are output and displayed in two consecutive time periods respectively.

In the method, the pixel unit 110 may be a combination of an R sub-pixel 111, a G sub-pixel 112 and a B sub-pixel 113 and may also be a combination type of sub-pixels of other colors. The pixel unit 110 generates a color every time when receiving a gray-scale value group. The gray-scale value group is generated by gray-scale data input into the display device. The gray-scale value group includes an R gray-scale value, a G gray-scale value and a B gray-scale value. The color generated by the pixel unit 110 may be any one of three types of a unitary color, a binary mixed color and a ternary mixed color and may also be a mixed color type combined by sub-pixels of unitary colors.

The pixel unit 110 includes the R sub-pixel 111, the G sub-pixel 112 and the B sub-pixel 113. The color generated by the pixel unit 110 may be any one of the three types of the unitary color, the binary mixed color and the ternary mixed color. The grouping rule is specifically as follows.

Minimum original gray-scale data in the original gray-scale data group corresponding to a ternary mixed color pixel unit 110 is used as common gray-scale data of the R sub-pixel 111, G sub-pixel 112 and B sub-pixel 113 in the pixel unit to form the first gray-scale data group.

Minimum non-zero gray-scale data in a difference data group obtained by subtracting the first gray-scale data group from the original gray-scale data group corresponding to the ternary mixed color pixel unit 110 is used as common gray-scale data of the sub-pixels corresponding to non-zero gray-scale data in the difference data group to form the second gray-scale data group together with zero gray-scale data.

Alternatively, minimum non-zero gray-scale data in the original gray-scale data group corresponding to a binary mixed color pixel unit 110 is used as common gray-scale data of the sub-pixels corresponding to two pieces of non-zero gray-scale data in the pixel unit 110 to form the first gray-scale data group together with the zero gray-scale data. The difference data group obtained by subtracting the first gray-scale data group from the original gray-scale data group is used as the second gray-scale data group of the pixel unit 110.

Alternatively, gray-scale data corresponding to half of gray-scale values corresponding to non-zero gray-scale data in the original gray-scale data group corresponding to a unitary mixed color pixel unit 110 is used as gray-scale data of the sub-pixels corresponding to the non-zero gray-scale data in the pixel unit 110 to form the first gray-scale data group and the second gray-scale data group together with the zero gray-scale data respectively.

It is assumed that an original gray-scale data group corresponding to a certain pixel unit 110 is converted into an original gray-scale value group (A, B, C). That is, a gray-scale value corresponding to the R sub-pixel 111 is A, a gray-scale value corresponding to the G sub-pixel 112 is B and a gray-scale value corresponding to the B sub-pixel 113 is C. When A>B>C, it can be determined that the gray-scale value corresponding to the B sub-pixel 113 is a minimum gray-scale value, i.e., a smallest gray-scale value, in the original gray-scale values, and a difference between front-viewing-angle luminance and side-viewing-angle luminance at the minimum gray-scale value is maximum. For reducing impact of the minimum gray-scale value, the minimum gray-scale value is now used as a common gray-scale value of the R sub-pixel 111, the G sub-pixel 112 and the B sub-pixel 113 to form a first gray-scale value group, i.e., (C, C, C). A difference group obtained by subtracting the minimum gray-scale value from the gray-scale values corresponding to the R sub-pixel 111, the G sub-pixel 112 and the B sub-pixel 113 in the original gray-scale data is used as a second gray-scale value group, i.e., (A-C, B-C, 0). By means of such setting, the minimum gray-scale value can be eliminated from the second gray-scale value group and impact of the minimum gray-scale value on the color shift under a large-viewing-angle condition during display of the second gray-scale value group can be eliminated. A ratio of a gray-scale value sum of decomposed dominant colors to a low gray-scale value is increased, so that not only is the color shift at a side viewing angle alleviated but also luminance of the dominant colors is increased.

In the above contents, each of the gray-scale value data group and the gray-scale value group is a data group using the pixel unit 110 as a minimum unit and including the gray-scale data or gray-scale values corresponding to the R sub-pixel 111, the G sub-pixel 112 and the B sub-pixel 113 respectively. The original gray-scale data group is an original gray-scale value data group including the RGB gray-scale data and input into the display device. The original gray-scale value group is a gray-scale value group directly converted from the original gray-scale data group and including the RGB gray-scale data.

In the grouping rule, the original gray-scale data groups corresponding to a binary mixed color and a unitary color are decomposed into two gray-scale data groups for synchronization with an execution control manner for the gray-scale data group corresponding to a ternary mixed color and convenient drive and control.

In addition, the driving method further includes that a driving frequency of each pixel unit is increased to be 1 to 3 times of an original frequency to compensate for a display speed reduced by gray-scale value decomposition. Decomposing an original gray-scale value into two gray-scale values for display in two consecutive time periods prolongs display time of a picture to be twice of original time, namely reduces the display speed to be half of the original speed. For compensating for the display speed reduced by gray-scale value decomposition, the driving frequency may be increased.

In an embodiment, the driving frequency of each pixel unit is increased to be twice of the original frequency to keep a display speed of the pixel unit subjected to gray-scale value decomposition the same as a display speed before gray-scale value decomposition. By means of such setting, picture fluency after gray-scale value decomposition for display is kept substantially the same as picture fluency during original gray-scale data display and the problem of color shift of liquid crystal display is alleviated without affecting the original visual effect.

In an embodiment, the liquid crystal display device further includes a backlight module 300. The backlight module 300 includes a backlight unit 320 configured to provide a backlight source. The driving method further includes that luminance of the backlight unit 320 is increased to be 1 to 3 times of original luminance to compensate for display luminance reduced by gray-scale value decomposition, or increase of the driving frequency or co-actions of gray-scale value decomposition and increase of the driving frequency. A gray-scale value decomposition process refers to decomposing an original high gray-scale value into two new low gray-scale values. That is, a group of high-voltage signals are actually decomposed into two groups of low-voltage signals, so that the luminance is reduced. On the other hand, since an original gray-scale value is decomposed into two gray-scale values for display in two consecutive time periods, the display time of the picture is prolonged to be twice of the original time. That is, the display speed is reduced to be ½ of the original speed. To compensate the display speed reduced by gray-scale value decomposition, the driving frequency is usually increased. After the driving frequency is increased, the luminance may be reduced because practical display time of each gray-scale data group is shorter than that under the original driving frequency. For example, if the original driving frequency is increased to be twice of the original driving frequency, the luminance is reduced since practical display time of a drive signal is shortened to be ½ of original time of the drive signal. To compensate for the luminance reduced by gray-scale value decomposition, or increase of the driving frequency or co-actions of gray-scale value decomposition and increase of the driving frequency, the backlight luminance can be increased.

In an embodiment, the luminance of the backlight unit 320 is increased to be twice of the original luminance to keep luminance of the pixel unit subjected to gray-scale value decomposition the same as luminance before gray-scale value decomposition. By means of such setting, an effect after gray-scale value decomposition for display is kept substantially the same as an effect during original gray-scale data display and the problem of color shift of liquid crystal display is alleviated without affecting the original visual effect.

According to the method, the type of the color corresponding to the original gray-scale data group to be displayed by each pixel unit is determined, and the original gray-scale data group is divided into the first gray-scale data group and the second gray-scale data group according to the type of the color corresponding to the original gray-scale data group to be displayed by each pixel unit in accordance with the set grouping rule for respective output and display in the two consecutive time periods. By means of such setting, a luminance ratio of a dominant hue is increased and a color shift condition caused by the fact that the dominant hue is affected by low-voltage sub-pixels at a large viewing angle is alleviated. In addition, the presentation luminance of a main signal under a large-viewing-angle condition is increased. Moreover, the backlight luminance is increased to be twice of original luminance to keep overall picture display luminance unchanged and the driving frequency is increased to be twice of the original driving frequency to keep an overall picture display speed unchanged. Meanwhile, additional wires arranged on a liquid crystal display panel are also avoided in this application.

In an embodiment, the backlight unit 320 may be an RGB type LED light source, a white light type LED light source or another light source and will not be limited herein.

This application also provides a driving method for a liquid crystal display device. The liquid crystal display device includes a display module. The display module 100 includes a plurality of pixel units 110 arranged in an array. The driving method is as follows.

A type of a color corresponding to an original gray-scale data group to be displayed by an $n^{th}$ pixel unit is determined.

The original gray-scale data group is divided into a first gray-scale data group and a second gray-scale data group according to the type of the color corresponding to the original gray-scale data group to be displayed by the $n^{th}$ pixel unit in accordance with a set grouping rule.

The first gray-scale data group and the second gray-scale data group are output and displayed in two consecutive time periods respectively.

Herein, n is an integer greater than or equal to 1.

In an embodiment, the pixel unit includes a plurality of sub-pixels of different colors.

In an embodiment, the pixel unit 110 includes an R sub-pixel 111, a G sub-pixel 112 and a B sub-pixel 113. The pixel unit 110 generates a color every time when receiving a gray-scale value group. The gray-scale value group is generated by gray-scale data input into the display device. The gray-scale value group includes an R gray-scale value, a G gray-scale value and a B gray-scale value. A color generated by the pixel unit is any one of three types of a unitary color, a binary mixed color and a ternary mixed color.

According to the driving method for a liquid crystal display device, the driving method may be used for the liquid crystal display device for a set region or for part of regions according to the property of displayed data. By means of such setting, a luminance ratio of a dominant hue in a liquid crystal display region for which the driving method is used can be increased and a color shift condition caused by the fact that the dominant hue is affected by low-voltage sub-pixels at a large viewing angle is alleviated. In addition, presentation luminance of a main signal under a large-viewing-angle condition in the liquid crystal display region for which the driving method is used can be increased. Moreover, backlight luminance is increased to be twice of original luminance to keep overall picture display luminance unchanged and a driving frequency is increased to be twice of an original driving frequency to keep an overall picture display speed unchanged. Meanwhile, additional wires arranged on a liquid crystal display panel are also avoided in this application.

According to the driving method for a liquid crystal display device, this application also provides a liquid crystal display device adopting the driving method.

FIG. 1 illustrates a liquid crystal display device. The liquid crystal display device includes a display module 100, a drive module 200 and a backlight module 300. The display module 100 includes a plurality of pixel units 110 arranged in an array and each pixel unit includes an R sub-pixel 111, a G sub-pixel 112 and a B sub-pixel 113. The backlight module 300 includes a power processing unit 310 and a backlight unit 320. The display module 100 is configured to display graphic and text information. The drive module 200 is configured to receive, process and output drive data to control the display module to normally work. The backlight module 300 is configured to convert a direct current voltage into a high-frequency high-voltage alternating current to turn on the backlight unit 320.

The drive module 200 includes a gray-scale data decomposition processing unit 210, a driving frequency regulation unit 220 and a backlight luminance regulation unit 230.

Herein, the gray-scale data decomposition processing unit 210 is connected to all of the R sub-pixels 111, the G sub-pixels 112 and the B sub-pixels 113 in the display module 100 and is configured to decompose input original gray-scale data corresponding to the pixel unit 110 into three groups of new gray-scale data and output gray-scale values corresponding to each sub-pixel in the pixel unit 110.

The driving frequency regulation unit 220 is configured to regulate a driving frequency. Decomposing an original gray-scale value into three gray-scale values for display in three consecutive time periods prolongs display time of a picture to be three times of original time, namely reduces the display speed to be ⅓ of the original speed. To compensate for the display speed reduced by gray-scale value decomposition, the driving frequency can be increased. A manner for increasing the driving frequency may be addition of hardware, or change of a software drive program or change of both of the hardware and the software drive program.

The backlight luminance regulation unit 230 is configured to regulate luminance of the backlight unit 320. A gray-scale data decomposition process refers to decomposing an original high gray-scale value group into three new low gray-scale value groups. That is, a group of high-voltage signals are actually decomposed into three groups of low-voltage signals, so that the luminance is reduced. To compensate for the luminance reduced by gray-scale value decomposition, the backlight luminance can be increased. That is, a backlight intensity is improved. A manner for increasing the luminance of the backlight unit 320 may be addition of the hardware, or change of the software drive program or change of both of the hardware and the software drive program.

According to the liquid crystal display device, the driving frequency of the drive module and the backlight luminance of the backlight module are changed, so that the display device can be applied to the foregoing driving method and a color shift under a large-viewing-angle condition is alleviated without affecting the original visual effect of a picture.

According to the driving method for a liquid crystal display device, this application also provides another liquid crystal display device adopting the driving method.

As shown in FIG. 1, the liquid crystal display device includes a display module 100, a drive module 200 and a backlight module 300. The display module 100 includes a plurality of pixel units 110 arranged in an array and each pixel unit includes an R sub-pixel 111, a G sub-pixel 112 and a B sub-pixel 113. The backlight module 300 includes a power processing unit 310 and a backlight unit 320. The display module 100 is configured to display graphic and text information. The drive module 200 is configured to receive, process and output drive data to control the display module to normally work. The backlight module 300 is configured to convert a direct current voltage into a high-frequency high-voltage alternating current to turn on the backlight unit 320.

The drive module 200 includes a gray-scale value decomposition processing unit 210.

The gray-scale value decomposition processing unit 210 is connected to all of the R sub-pixels 111, the G sub-pixels 112 and the B sub-pixels 113 in the display module 100 and is configured to decompose input original gray-scale data corresponding to each pixel unit into two groups of new gray-scale data and output and display them in two consecutive time periods respectively as gray-scale values of the R sub-pixels 111, the G sub-pixels 112 and the B sub-pixels 113 in each pixel unit 110.

In addition, the drive module 200 further includes a driving frequency regulation unit 220, or a backlight luminance regulation unit 230, or the driving frequency regulation unit 220 and the backlight luminance regulation unit. The driving frequency regulation unit 220 is configured to regulate a driving frequency. The backlight luminance regulation unit 230 is configured to regulate luminance of the backlight unit 320. Decomposing an original gray-scale value into two gray-scale values for display in two consecutive time periods prolongs display time of a picture to be twice of original time, namely reduces the display speed to be half of the original speed. To compensate for the display speed reduced by gray-scale value decomposition, the driving frequency can be increased. A manner for increasing the driving frequency may be addition of hardware, or change of a software drive program or addition of the hardware and change of the software drive program. A gray-scale value decomposition process refers to decomposing an original high gray-scale value into two new low gray-scale values. That is, a group of high-voltage signals are actually decomposed into two groups of low-voltage signals, so that the luminance is reduced. To compensate for the luminance reduced by gray-scale value decomposition, the backlight luminance can be increased. That is, a backlight intensity is improved. A manner for increasing the luminance of the backlight unit 320 may be change of the hardware, or change of the software drive program or change of both of the hardware and the software drive program.

According to the liquid crystal display device, the driving frequency of the drive module and the backlight luminance of the backlight module are changed, so that the display device can be applied to the above driving method and a color shift under a large-viewing-angle condition is alleviated without affecting the original visual effect of a picture.

The "backlight unit 320" in any embodiment may be an integrated luminous body and may also be any luminous body in a plurality of independent or mutually associated luminous bodies. Herein, turning-on and turning-off processes of any luminous body in the independent or mutually associated luminous bodies may be independently controlled.

Technical features of the foregoing embodiments may be randomly combined. For the brevity of description, not all possible combinations of the technical features in the foregoing embodiments are described. However, as long as combinations of these technical features do not contradict each other, it should be considered that the combinations all fall within the scope of this specification.

The foregoing embodiments only describe several implementations of this application, which are described specifically and in detail, and therefore cannot be construed as a limitation to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

What is claimed is:

1. A driving method for a liquid crystal display device, the liquid crystal display device comprising a display module, the display module comprising a plurality of pixel units arranged in an array, and the driving method comprising:

determining a type of a color corresponding to an original gray-scale data group to be displayed by each pixel unit;

dividing the original gray-scale data group into a first gray-scale data group, a second gray-scale data group and a third gray-scale data group according to the type of the color corresponding to the original gray-scale data group to be displayed by the pixel unit in accordance with a set grouping rule; and outputting and displaying, in three consecutive time periods respectively, the first gray-scale data group, the second gray-scale data group and the third gray-scale data group;

wherein the determining the type of the color corresponding to the original gray-scale data group to be displayed by the pixel unit comprises:

determining the type of the color corresponding to the original gray-scale data according to an amount of zero gray-scale data in the original gray-scale data group to be displayed by the pixel unit, comprising:

when the original gray-scale data group comprises no zero gray-scale data, determining that the color corresponding to the original gray-scale data group is a ternary mixed color;

when the original gray-scale data group comprises one piece of zero gray-scale data determining that the color corresponding to the original gray-scale data group is a binary mixed color; and when the original gray-scale data group comprises two pieces of zero gray-scale data determining that the color corresponding to the original gray-scale data group is a unitary color;

wherein the set grouping rule corresponding to ternary mixed color gray-scale data comprises:

using minimum original gray-scale data in the original gray-scale data group corresponding to a ternary mixed color pixel unit as common gray-scale data of a Red (R) sub-pixel, a Green (G) sub-pixel and a Blue (B) sub-pixel in the pixel unit to form the first gray-scale data group;

using minimum non-zero gray-scale data in a difference data group obtained by subtracting the first gray-scale data group from the original gray-scale data group corresponding to the ternary mixed color pixel unit as common gray-scale data of sub-pixels corresponding to non-zero gray-scale data in the difference data group to form the second gray-scale data group together with zero gray-scale data; and using a difference data group obtained by subtracting the first gray-scale data group and the second gray-scale data group from the original gray-scale data group corresponding to the ternary mixed color pixel unit as the third gray-scale data group.

2. The driving method according to claim 1, wherein the set grouping rule corresponding to binary mixed color gray-scale data comprises:

using zero gray-scale data in the original gray-scale data group corresponding to a binary mixed color pixel unit as common gray-scale data of the R sub-pixel, the G sub-pixel and the B sub-pixel in the pixel unit to form the first gray-scale data group; and using minimum non-zero gray-scale data in the original gray-scale data group corresponding to the binary mixed color pixel unit as common gray-scale data of sub-pixels corresponding to non-zero gray-scale data in the original gray-scale data group to form the second gray-scale data group together with the zero gray-scale data.

3. The driving method according to claim 1, wherein the set grouping rule corresponding to binary mixed color gray-scale data comprises:

using gray-scale data corresponding to half of gray-scale values corresponding to minimum non-zero gray-scale data in the original gray-scale data group corresponding to a binary mixed color pixel unit as common gray-scale data of sub-pixels corresponding to two pieces of non-zero gray-scale data in the pixel unit to form the first gray-scale data group and the second gray-scale data group together with zero gray-scale data respectively; and using a difference data group obtained by subtracting the first gray-scale data group and the second gray-scale data group from the original gray-scale data group corresponding to the binary mixed color pixel unit as the third gray-scale data group.

4. The driving method according to claim 1, wherein the set grouping rule corresponding to unitary color gray-scale data comprises:

using any piece of zero gray-scale data in the original gray-scale data group corresponding to a unitary color pixel unit as common gray-scale data of the R sub-pixel, the G sub-pixel and the B sub-pixel in the pixel unit to form the first gray-scale data group and the second gray-scale data group; and using the original gray-scale data group corresponding to the unitary color pixel unit as the third gray-scale data group.

5. The driving method according to claim 1, wherein the set grouping rule corresponding to a unitary color gray-scale data comprises:

using gray-scale data corresponding to ⅓ of the gray-scale values corresponding to non-zero gray-scale data in the original gray-scale data group corresponding to the unitary color pixel unit as gray-scale data of sub-pixels corresponding to non-zero gray-scale data in the pixel unit to form the first gray-scale data group, the second gray-scale data group and the third gray-scale data group together with zero gray-scale data respectively.

6. The driving method according to claim 1, further comprising:

increasing a driving frequency of the pixel unit to be 1 to 4 times of an original frequency to compensate for a display speed reduced by gray-scale value decomposition.

7. The driving method according to claim 6, wherein the driving frequency of the pixel unit is increased to be three times of the original frequency to keep a display speed of the pixel unit subjected to the gray-scale value decomposition the same as a display speed before the gray-scale value decomposition.

8. The driving method according to claim 1, further comprising:

increasing backlight luminance to be 1 to 4 times of original luminance to compensate for luminance reduced by gray-scale value decomposition, or increase of a driving frequency or co-actions of gray-scale value decomposition and increase of the driving frequency.

9. A driving method for a liquid crystal display device, the liquid crystal display device comprising a display module, the display module comprising a plurality of pixel units arranged in an array, and the driving method comprising:

determining a type of a color corresponding to an original gray-scale data group to be displayed by each pixel unit;

dividing the original gray-scale data group into a first gray-scale data group, a second gray-scale data group and a third gray-scale data group according to the type of the color corresponding to the original gray-scale data group to be displayed by each pixel unit in accordance with a set grouping rule; and outputting and displaying, in three consecutive time periods respectively, the first gray-scale data group, the second gray-scale data group and the third gray-scale data group corresponding to each pixel unit;

wherein the determining the type of the color corresponding to the original gray-scale data group to be displayed by each pixel unit comprises:

determining the type of the color corresponding to original gray-scale data according to an amount of zero gray-scale data in the original gray-scale data group to be displayed by the pixel unit, comprising:

when the original gray-scale data group comprises no zero gray-scale data, determining that the color corresponding to the original gray-scale data group is a ternary mixed color;

when the original gray-scale data group comprises one piece of zero gray-scale data, determining that the color corresponding to the original gray-scale data group is a binary mixed color; and when the original gray-scale data group comprises two pieces of zero gray-scale data, determining that the color corresponding to the original gray-scale data group is a unitary color;

wherein the set grouping rule corresponding to ternary mixed color gray-scale data comprises:

using minimum original gray-scale data in the original gray-scale data group corresponding to a ternary mixed color pixel unit as common gray-scale data of a Red (R) sub-pixel, a Green (G) sub-pixel and a Blue (B) sub-pixel in the pixel unit to form the first gray-scale data group;

using minimum non-zero gray-scale data in a difference data group obtained by subtracting the first gray-scale data group from the original gray-scale data group corresponding to the ternary mixed color pixel unit as common gray-scale data of sub-pixels corresponding to non-zero gray-scale data in the difference data group to form the second gray-scale data group together with zero gray-scale data; and using a difference data group obtained by subtracting the first gray-scale data group and the second gray-scale data group from the original gray-scale data group corresponding to the ternary mixed color pixel unit as the third gray-scale data group.

10. The driving method according to claim 9, wherein the set grouping rule corresponding to binary mixed color gray-scale data comprises:

using zero gray-scale data in the original gray-scale data group corresponding to a binary mixed color pixel unit as common gray-scale data of the R sub-pixel, the G sub-pixel and the B sub-pixel in the pixel unit to form the first gray-scale data group; and using minimum non-zero gray-scale data in the original gray-scale data group corresponding to the binary mixed color pixel unit as common gray-scale data of sub-pixels corresponding to non-zero gray-scale data in the original gray-scale data group to form the second gray-scale data group together with the zero gray-scale data;

or using gray-scale data corresponding to half of gray-scale values corresponding to the minimum non-zero gray-scale data in the original gray-scale data group corresponding to the binary mixed color pixel unit as common gray-scale data of sub-pixels corresponding to two pieces of non-zero gray-scale data in the pixel unit to form the first gray-scale data group and the second gray-scale data group together with the zero gray-scale data respectively; and using a difference data group obtained by subtracting the first gray-scale data group and the second gray-scale data group from the original gray-scale data group corresponding to the binary mixed color pixel unit as the third gray-scale data group.

11. The driving method according to claim 9, wherein the set grouping rule corresponding to unitary color gray-scale data comprises:

using any piece of zero gray-scale data in the original gray-scale data group corresponding to a unitary color pixel unit as common gray-scale data of the R sub-pixel, the G sub-pixel and the B sub-pixel in the pixel unit to form the first gray-scale data group and the second gray-scale data group; and using the original gray-scale data group corresponding to the unitary color pixel unit as the third gray-scale data group;

or using gray-scale data corresponding to ⅓ of gray-scale values corresponding to the non-zero gray-scale data in the original gray-scale data group corresponding to the unitary color pixel unit as gray-scale data of sub-pixels corresponding to the non-zero gray-scale data in the pixel unit to form the first gray-scale data group, the second gray-scale data group and the third gray-scale data group together with the zero gray-scale data respectively.

12. The driving method according to claim 9, further comprising:

increasing a driving frequency of the pixel unit to be 1 to 4 times of an original frequency to compensate for a display speed reduced by gray-scale value decomposition.

13. The driving method according to claim 9, further comprising:

increasing backlight luminance to be 1 to 4 times of original luminance to compensate for luminance reduced by gray-scale value decomposition, or increase of a driving frequency or co-actions of gray-scale value decomposition and increase of the driving frequency.

14. A liquid crystal display device, comprising:

a display module, configured to display graphic and text information, the display module comprising a plurality of pixel units arranged in an array, and each pixel unit comprising a Red (R) sub-pixel, a Green (G) sub-pixel and a Blue (B) sub-pixel;

a drive module, configured to receive, process and output drive data to control the display module to normally work, the drive module comprising a gray-scale data decomposition processing unit, a driving frequency regulation unit and a backlight luminance regulation unit, the gray-scale data decomposition processing unit being configured to decompose an input original gray-scale data group corresponding to the pixel unit into three new gray-scale data groups and output gray-scale values of the R sub-pixel, the G sub-pixel and the B sub-pixel in the pixel units in three consecutive time periods, and the three new gray-scale data groups being output and displayed in the three consecutive time periods, wherein the three new gray-scale data groups are obtained according to a type of a color corresponding to an original gray-scale data group to be displayed by the pixel unit in accordance with a set grouping rule, and the type of the color corresponding to the original gray-scale data group to be displayed by the pixel unit is determined according to an amount of zero gray-scale data in the original gray-scale data group to be displayed by the pixel unit, wherein when the original gray-scale data group comprises no zero gray-scale data, the color corresponding to the original gray-scale data group is a ternary mixed color is determined;

when the original gray-scale data group comprises one piece of zero gray-scale data, the color corresponding to the original gray-scale data group is a binary mixed color is determined; and when the original gray-scale data group comprises two pieces of zero gray-scale data, the color corresponding to the original gray-scale data group is a unitary color is determine;

the set grouping rule corresponding to ternary mixed color gray-scale data comprises:

using minimum original gray-scale data in the original gray-scale data group corresponding to a ternary mixed color pixel unit as common gray-scale data of a Red (R) sub-pixel, a Green (G) sub-pixel and a Blue (B) sub-pixel in the pixel unit to form the first gray-scale data group;

using minimum non-zero gray-scale data in a difference data group obtained by subtracting the first gray-scale data group from the original gray-scale data group corresponding to the ternary mixed color pixel unit as common gray-scale data of sub-pixels corresponding to non-zero gray-scale data in the difference data group to form the second gray-scale data group together with zero gray-scale data; and using a difference data group obtained by subtracting the first gray-scale data group and the second gray-scale data group from the original gray-scale data group corresponding to the ternary mixed color pixel unit as the third gray-scale data group;

the gray-scale data decomposition processing unit being connected to all of the R sub-pixels, the G sub-pixels and the B sub-pixels in the display module, the driving frequency regulation unit being configured to regulate a driving frequency, and the backlight luminance regulation unit being configured to regulate luminance of a backlight unit; and a backlight module, configured to convert a direct current voltage into a high-frequency high-voltage alternating current to turn on the backlight unit, the backlight module comprising a power processing unit and the backlight unit.

* * * * *